US008613787B2

(12) United States Patent
Pretorius et al.

(10) Patent No.: US 8,613,787 B2
(45) Date of Patent: Dec. 24, 2013

(54) METHOD FOR THE COMMERCIAL PRODUCTION OF IRON

(75) Inventors: Gerard Pretorius, Centurion (ZA); Derek Roy Oldnall, Pretoria (ZA)

(73) Assignee: Iron Mineral Beneficiation Services (Proprietary) Limited, Johannesburg (ZA)

( * ) Notice: Subject to any disclaimer, the term of this patent is extended or adjusted under 35 U.S.C. 154(b) by 674 days.

(21) Appl. No.: 12/375,760

(22) PCT Filed: Jul. 31, 2007

(86) PCT No.: PCT/IB2007/053016

§ 371 (c)(1),
(2), (4) Date: Jan. 30, 2009

(87) PCT Pub. No.: WO2008/020357

PCT Pub. Date: Feb. 21, 2008

(65) Prior Publication Data

US 2009/0260483 A1 Oct. 22, 2009

(30) Foreign Application Priority Data

Aug. 1, 2006 (ZA) ..... 2006/06360

(51) Int. Cl.
*C21B 15/00* (2006.01)
*C22B 5/00* (2006.01)

(52) U.S. Cl.
USPC ..... 75/347; 75/330; 75/343; 75/345

(58) Field of Classification Search
USPC ..... 75/347, 330, 343, 345
See application file for complete search history.

(56) References Cited

U.S. PATENT DOCUMENTS

| | | | | |
|---|---|---|---|---|
| 3,645,717 | A | 2/1972 | Meyer et al. | |
| 4,330,325 | A * | 5/1982 | Keran et al. | 75/477 |
| 4,443,250 | A | 4/1984 | Meyer et al. | |

FOREIGN PATENT DOCUMENTS

| | | |
|---|---|---|
| DE | 2 020 306 | 11/1971 |
| GB | 487692 | 6/1938 |
| GB | 1138695 | 1/1969 |

OTHER PUBLICATIONS

International Search Report, PCT/IB2007/053016 issued Mar. 11, 2008 by the European Patent Office (ISA/EP).
Written Opinion of the International Searching Authority, PCT/IB2007/053016 issued Mar. 11, 2008 by the International Searching Authority in the European Patent Office.
(Second) Written Opinion of the International Preliminary Examining Authority, PCT/IB2007/053016 issued Aug. 4, 2008 by the International Preliminary Examining Authority in the European Patent Office.
International Preliminary Report on Patentability PCT/IB2007/053016 issued Oct. 13, 2008 by the International Preliminary Examining Authority in the European Patent Office.

(Continued)

*Primary Examiner* — Rebecca Lee
(74) *Attorney, Agent, or Firm* — Marshall, Gerstein & Borun LLP

(57) ABSTRACT

A method for the production of iron from an iron oxide-containing material includes contacting an iron oxide-containing material with a particle size distribution range with a $\partial^{90}$ of less than 2 mm, with a carbon-containing material with a particle size distribution range with a $\partial^{90}$ of less than 6 mm, in a commercial scale reactor at a temperature of between 900° C. and 1200° C. for a contact time sufficient to reduce the iron oxide to iron.

10 Claims, 2 Drawing Sheets

(56) References Cited

OTHER PUBLICATIONS

Figure 1:
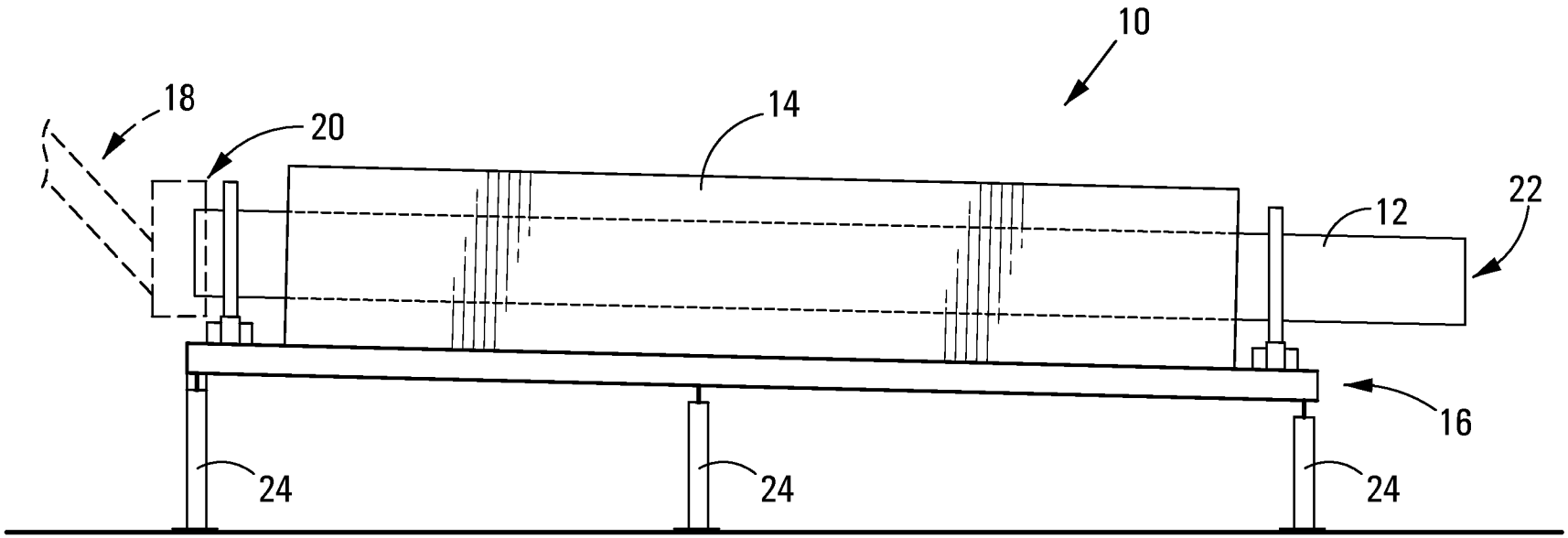

Zervas et al., "Solid-Based Processes for the Direct Reduction of Iron," *Int.l J. Energy Research*, vol. 20, No. 3, (Mar. 1996) pp. 255-278 XP008079317-ISSN: 0363-907X.

Hauser WD: "Codir Process for Coal-based Direct Reduction of Iron Ore," *Iron and Steel Engineer*, vol. 67, No. 6 (Jun. 1, 1990), pp. 38-43, XP000140714-ISSN: 0021-1559.

* cited by examiner

METHOD FOR THE COMMERCIAL PRODUCTION OF IRON

This application is a U.S. National Phase Application pursuant to 35 U.S.C. 371 of International Application No. PCT/IB2007/053016, which was filed Jul. 31, 2007, claiming benefit of priority of South African Patent Application No. 2006/06360, which was filed Aug. 1, 2006.

THIS INVENTION relates to a method for the commercial production of iron. It also relates to a reactor assembly and a vehicle for use in the commercial production of iron.

In historical times, iron was produced by reducing iron oxide with charcoal. In this process, the charcoal acted both as the source of heat and as the reducing agent. The product was an alloy consisting of about 96.5% iron and about 3.5% carbon. Charcoal was later supplanted by coke. At present, iron is produced largely from the iron ores haematite ($Fe_2O_3$) and magnetite ($Fe_3O_4$) by carbothermic reduction in a blast furnace at temperatures of about 2000° C. In this process, the iron ore, carbon in the form of coke and a flux such as limestone are fed into the top of the furnace and a blast of heated air is forced into the bottom of the furnace. In the furnace, the coke reacts with oxygen in the air blast to produce carbon monoxide and the carbon monoxide reduces the iron ore to iron, becoming oxidised to carbon dioxide in the process. The iron produced in this process is call pig iron. As a result of the high gas flow rate in blast furnaces, the iron oxide and coke have to be in relatively coarse particulate form, preferably with particle sizes larger than about 6 mm. If the particle size is substantially less than 6 mm, the feedstock will simply be blown out of the top of the blast furnace by the gas stream. In addition, there are inherent problems associated with the operation of blast furnaces in preventing the formation of hot and cold zones which can results in back reactions and competing reactions.

In the mining, transport and storage of iron ore and coal, large amounts of iron oxide fines and coal fines, usually referred to as duff, are produced. Finely divided iron oxide is also produced as a by-product both in the production of copper, e.g. in the case of Phalaborwa Mining Corporation in South Africa or Freeport (Grasberg) in Indonesia and from the roasting of $FeS_2$ in the production of sulphuric acid. These finely divided materials could provide a source of raw material for the production of iron. However, for the reasons set out above, unless these materials are first granulated, they cannot be used in blast furnaces, but granulation is not economically viable. It is an object of the invention to address this problem.

According to one aspect of the invention, there is provided a method for the production of iron from an iron oxide-containing material, the method including contacting an iron oxide-containing material with a particle size distribution range with a $\partial^{90}$ of less than 2 mm, with a carbon-containing material with a particle size distribution range with a $\partial^{90}$ of less than 6 mm, in a commercial scale reactor at a temperature of between 900° C. and 1200° C. for a contact time sufficient to reduce the iron oxide to iron.

Preferably, substantially all of the iron oxide-containing material is reduced to iron.

As is well known to those skilled in the art, $\partial^{90}$ means that at least 90% of the material has a particle size less than that specified, i.e. a $\partial^{90}$ of 2 mm means that at least 90% of the particulate material has a particle size of less than 2 mm. $\partial^{90}$ is also often simply written as d90.

By "commercial scale reactor" is meant a reactor capable of routinely producing at least 1000 kg/h of iron.

The iron oxide-containing material may have a $\partial^{90}$ of less than 1 mm. Preferably, the iron oxide-containing material has a $\partial^{90}$ of less than 500 μm.

The carbon-containing material may have a $\partial^{90}$ of less than 2 mm. Preferably, the carbon-containing material has a $\partial^{90}$ of less than 1 mm.

The contact time may be between 30 minutes and 360 minutes. The contact time is preferably between about 60 minutes and about 180 minutes and more preferably about 120 minutes.

The method may include contacting the iron oxide-containing material with the carbon-containing material in the presence of a flux such as calcium oxide or quicklime.

The iron oxide-containing material may be waste iron oxide. It may in particular be the waste product produced in the mining of iron ore, in the production of copper or in the production of sulphuric acid. This material typically has a particle size with a $\partial^{90}$ of less than about 500 μm and usually consists of haematite or magnetite. The carbon-containing material may be waste coal or coal fines, often referred to as duff which is produced during the mining and transport of coal. Instead, the carbon-containing material may be the waste material produced in the distillation or devolatilisation of coal.

The carbon-containing material is preferably de-volatilised coal fines. This material typically has a particle size with a $\partial^{90}$ of less than about 6 mm.

The temperature in the reactor may be between 1000° C. and 1100° C., e.g. about 1050° C.

The method may include heating the reactor using an external heat source. Typically, the reactor is heated electrically.

By carrying out the reduction at a temperature of about 1050° C. using external electric heating, the method of the invention can be carefully controlled. The equilibrium between CO and $CO_2$ at different temperatures is set out below:

| | CO | $CO_2$ |
|---|---|---|
| 450° C.: | 2% | 98% |
| 750° C. | 76% | 24% |
| 1050° C. | 99.6% | 0.4% |

Thus by controlling the temperature at approximately 1050° C. the $CO/CO_2$ equilibrium lays almost entirely on the CO side.

The traditional method of making iron as carried out in blast furnaces requires the use of carbonaceous fluxes, such as $CaCO_3$ to increase the $CO_2$ concentration inside the furnace. However, this not only increases the gas velocity but the decomposition of $CaCO_3$ is endothermic and increases the energy demand. The decomposition of $CaCO_3$ occurs at about 900° C., $$CaCO_3 = CaO + CO_2$$

| | temp: | | | | |
|---|---|---|---|---|---|
| | 500° C. | 600° C. | 700° C. | 800° C. | 900° C. |
| mm Hg: | 0.11 | 2.35 | 25.3 | 168 | 760 |

The formation of $FeSiO_3$ and $Fe_2SiO_4$ occurs from above 700° C. and active CaO is needed to react with the $SiO_2$ before it combines with the FeO.

Contacting the iron oxide-containing material with the carbon-containing material may include feeding pre-determined quantities of said materials into a rotating cylindrical reactor or rotary kiln and setting the rate of rotation and the angle of the reactor so that the residence time of the material in the reactor is sufficient to reduce substantially all of the iron oxide to iron.

The method may include preventing ingress of air into the reactor.

The feed rates of the iron oxide-containing material and the carbon-containing material and the operating temperature of the reactor may be selected so that a superficial gas flow rate through the reactor caused by the release of gases resulting from the reduction is low enough to prevent any substantial entrainment and consequent loss of the finely divided iron oxide-containing material and carbon-containing material from the reactor. Typically, the superficial gas flow rate is less than 2 $ms^{-1}$, preferably about 1 $ms^{-1}$.

The method may include controlling iron oxide-containing material and carbon-containing material feed rate, reactor temperature and gas withdrawal rate from the reactor to achieve a substantially steady state concentration of carbon monoxide in the reactor.

The method may include the step of recovering excess carbon monoxide withdrawn from the reactor and using the excess carbon monoxide to produce energy. The energy produced may be used to heat the reactor.

The product produced according to the method of the invention, at least initially, is a granular iron with a particle size similar to that of the particle size of the iron oxide-containing material.

The method may include contacting the iron oxide-containing material with a slight excess of the carbon-containing material (e.g. about 5%-30% excess), magnetically separating product iron from excess carbon-containing material (e.g. distilled duff coal), and melting the iron product, producing mild steel with a purity in excess of 99% by mass.

The purity of the iron produced after magnetic removal of carbon is thus typically in excess of 99%. This is the purity of mild steel. In addition, by adding suitable quantities of chromium, nickel or manganese, the product produced can be in the form of a stainless steel.

According to another aspect of the invention, there is provided a method for the production of iron from an iron oxide-containing material, the method including reducing an iron oxide-containing material with a particle size distribution range with a $\partial^{90}$ of less than 2 mm, with a carbon-containing material with a particle size distribution range with a $\partial^{90}$ of less than 6 mm, in a commercial scale reactor at an elevated temperature, the reduction producing carbon monoxide and the method further including feeding the materials into the reactor at a rate and at a temperature, and withdrawing carbon monoxide from the reactor at a rate, selected so that a substantially steady state of concentration of carbon monoxide is maintained in the reactor.

The iron oxide-containing material and the carbon-containing material may be as hereinbefore described.

The iron oxide-containing material and the carbon-containing material may be fed into the reactor at a rate which is selected so that the carbon monoxide which is produced in the reduction process flows through the reactor at a superficial gas flow rate of less than about 2 $ms^{-1}$ and preferably at about 1 $ms^{-1}$.

According to yet another aspect of the invention, there is provided a method for the production of iron from an iron oxide-containing material, the method including reducing an iron oxide-containing material with a particle size distribution range with a $\partial^{90}$ of less than 2 mm, with a carbon-containing material with a particle size distribution range with a $\partial^{90}$ of less than 6 mm, in a commercial scale reactor, the method further including feeding the materials into the reactor at a rate, and operating the reactor at an elevated temperature, such that a superficial gas flow rate in the reactor caused by the release of gases resulting from the reduction is less than 2 $ms^{-1}$.

The iron oxide-containing material and the carbon-containing material may be as hereinbefore described.

Preferably, the temperature will be between about 1000° C. and 1100° C. and more preferably about 1050° C.

Preferably the superficial gas flow rate will be about 1 $ms^{-1}$.

Preferably, substantially all of the iron oxide-containing material is reduced.

According to a further aspect of the invention, there is provided a reactor assembly suitable for use in the commercial production of iron from an iron oxide-containing material which has a particle size distribution range with a $\partial^{90}$ of less than about 2 mm by contacting the material with a carbon-containing material which has a particle size distribution range with a $\partial^{90}$ of less than about 6 mm at an elevated temperature, the reactor assembly including a generally cylindrical reactor with an inlet and an outlet mounted for rotation about a longitudinal axis thereof, heating means for heating the reactor to a temperature of between about 900° C. and 1200° C. and mounting means for mounting the assembly on a vehicle.

The heating means may be electrical heating means located external to the reactor. The assembly may include drive means for rotating the reactor.

The method extends to a vehicle with a mounted reactor assembly as claimed hereinbefore described.

Figure 2:
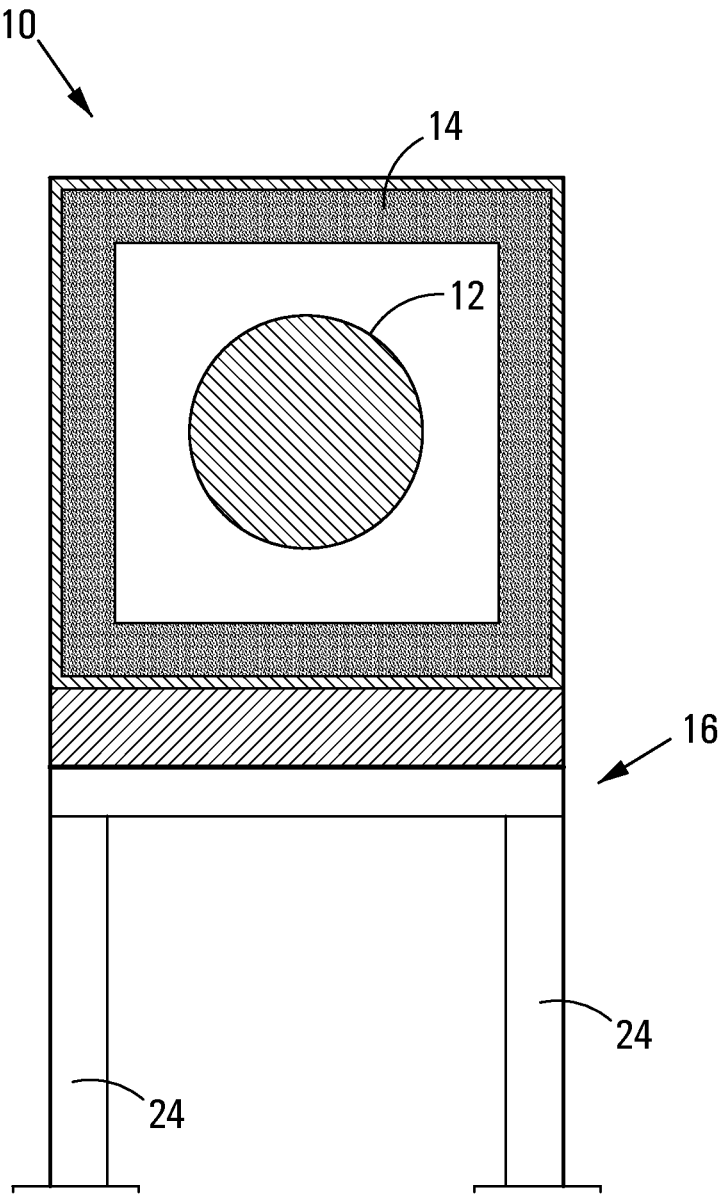

The invention is now described, by way of example, with reference to the following Examples and drawings in which FIG. 1 shows a schematic side view of a reactor for use in the method of the invention; and FIG. 2 shows, schematically, a section through the reactor of FIG. 1.

Referring to the drawings, reference numeral 10 generally indicates a reactor assembly in the form of an electrically heated rotary kiln for use in the method of the invention. The kiln 10 includes a cylindrical reactor tube 12 housed in an outer casing 14. The casing 14 has a square profile as can be seen in FIG. 2 with outer dimensions of about 2×2 m. The reactor 12 is mounted for rotation on a support frame, generally indicated by reference numeral 16. A feeder 18 feeds raw material into the inlet end 20 of the reactor tube 12. The feeder 18 is provided with a labyrinth seal (not shown) to prevent air flow into the reactor tube 12.

The reactor tube 12 is about 6 m long with a diameter of about 1 m and is electrically heated by heating elements (not shown) in the casing 14. The kiln 10 slopes from left to right as can be seen in the drawings and the support frame 16 is provided with an adjustment mechanism (not shown) to increase or decrease the slope or angle of the reactor tube 12 which together with varying the speed of rotation changes the rate of passage of raw material through the reactor tube 12. The outlet end 22 of the reactor tube 12 is provided with a seal (not shown) to prevent air contact with the granular iron product as it flows from the reactor tube 12. The frame 16 has support legs 24 which can be mounted on a vehicle (not shown) so that the entire reactor assembly can be transported to an area in which waste iron oxide and/or waste coal has been stockpiled.

Example 1

Magnetite from Phalaborwa Mining Company, South Africa with the following composition and size distribution was used in this Example:

| | |
|---|---|
| Fe | 66% |
| $Fe_3O_4$ | 91.2% |
| $SiO_2$ | 0.52% |
| $Al_2O_3$ | 1.08% |
| Sulphur | 0.11% |
| Phosphor | 0.04% |
| $\partial^{90}$ | −250 μm |
| $\partial^{50}$ | −106 μm |
| $\partial^{10}$ | −15 μm |

700 kg coal (refer to table 1) was devolatized to produce 400 kg devolatized coal as shown below:

TABLE 1

700 kg $\xrightarrow{900° C.}$ 400 kg (Under reducing conditions)

| | Coal | Devolatized coal |
|---|---|---|
| Fixed Carbon | 49% | 73% |
| Volatiles | 35% | 1.7% |
| Moisture | 3% | 1.5% |
| Ash | 13% | 22% |
| $SiO_2$ | — | 10% |
| $Al_2O_3$ | — | 4% |
| Sulphur | 1.5% | 1.5% |
| Phosphor | 0.02% | 0.02% |
| CV (MJ/kg) | 28 | 25 |
| Particle size | $\partial^{90}$-12 mm | $\partial^{90}$-500 μm |
| | $\partial^{50}$-3 mm | $\partial^{50}$-75 μm |
| | $\partial^{10}$-0.5 mm | $\partial^{10}$-10 μm |

Note:
After devolatization the coal was milled with a hammer mill.

kg $Al_2O_3$ and 5.2 kg $SiO_2$. 388 kg devolatized coal contains 38.8 kg $SiO_2$ and 15.5 kg $Al_2O_3$. Total $SiO_2$=44 kg=0.733 kmol and total $Al_2O_3$=26.3 kg=0.258 kmol. It was found that if equal mol amounts of lime are added to the mol amounts of $SiO_2$ and $Al_2O_3$, sintering during reduction is greatly minimized. Total lime needed=0.991 kmol CaO=55.5 kg, 89% purity=62.4 kg. The lime is milled to −500 μm, $\partial^{50}$=125 μm.

The reduction mixture (based on 1 ton magnetite) is thus:

1 ton Magnetite (91.2%) (dried at 300° C.)

388 kg devolatized coal (73%)

62 kg lime (89%)

1450 kg 2.9 tons of the reduction mixture was fed into a 9.7 m long, 0.96 m ID inclined reduction tube or rotary kiln at a feed rate of 300 kg/h. The tube was rotated at 1.12 rpm and material from the tube was collected in drums. After approximately 2 h, the first material was collected (refer to Table 2 below). The tube had 3 firing zones, namely zone 1 which is a feed zone, zone 2 which is a middle zone and zone 3 which is a discharge zone. The temperature in each zone was measured and is indicated in Table 2. To prevent the material from sticking to the sides, 2 mechanical hammers were used, at the feed end and the discharge end of the tube. The angle of the tube was equivalent to a drop of 5 mm/1 m over the length of the tube.

TABLE 2

| Time | Feed | Out | Drum | Zone 1 Temp | Zone 2 Temp | Zone 3 Temp | |
|---|---|---|---|---|---|---|---|
| 0 h 00 | 300 kg | - | - | 1064° C. | 1070° C. | 1071° C. | |
| 1 h 00 | 300 kg | - | - | 1042° C. | 1070° C. | 1069° C. | |
| 2 h 00 | 300 kg | 128 kg | 1 | 1029° C. | 1070° C. | 1073° C. | |
| 3 h 00 | 300 kg | 179 kg | 2/3 | 1029° C. | 1070° C. | 1068° C. | Steady state period. mass feed = 2000 kg |
| 4 h 00 | 300 kg | 193 kg | 4/5 | 1028° C. | 1070° C. | 1071° C. | |
| 5 h 00 | 300 kg | 188 kg | 6/7 | 1039° C. | 1071° C. | 1069° C. | |
| 6 h 00 | 300 kg | 198 kg | 8/9 | 1039° C. | 1069° C. | 1072° C. | |
| 7 h 00 | 300 kg | 207 kg | 10/11 | 1039° C. | 1071° C. | 1071° C. | |
| 8 h 00 | 300 kg | 189 kg | 12/13 | 1033° C. | 1071° C. | 1071° C. | |
| 9 h 00 | 200 kg | 158 kg | 14/15 | 1053° C. | 1071° C. | 1071° C. | |
| 10 h 00 | - | 74 kg | 16 | 1055° C. | 1071° C. | 1071° C. | |

The following formula represents the reduction equation for the magnetite:

$$Fe_3O_4+4C=3Fe+4CO(g)$$

Based on 1 mol $Fe_3O_4$, the following calculations can be done:

1 mol $Fe_3O_4$=231.54 g, 91.2% purity=253.88 g 4 mol C=48 g, 73% purity=65.75 g +50% excess devolatized coal=98.625 g (to exclude air in rotary)

It follows that, to reduce 1 ton magnetite in the rotary, you need 388 kg devolatized coal. 1 ton magnetite contains 10.8

After 10 hours the oven was switched off, and a $CO_2$ (g) flame combusting CO withdrawn from the tube still burned for another hour. Overnight, another 147 kg was discharged from the rotary while a bed load of 179 kg remained in the rotary. This material was discarded as it re-oxidized due to a lack of a CO-atmosphere. The material in drums 1 and 16 was also discarded.

According to the reduction equation given above, complete reduction of 253.9 g magnetite feed will result in 112 g CO (g) loss. Therefore, from a reduction mixture of 1450 kg, 441 kg CO (g) should evolve. This equals a mass loss of 30.4%. Depending on the efficiency of a rotary seal used to exclude air from the reduction tube and thus from the reduction process, the mass loss during steady state phase of reduction is normally between 34-37%. Care must also be taken to prevent the hot iron powder from re-oxidizing. This is normally achieved by water cooling of a chamber where the iron powder is fed through.

A good reduced iron powder (from magnetite or haematite), using the method of the invention, typically has the following XRD pattern:

| | |
|---|---|
| CaO | 2-5% |
| Haematite ($Fe_2O_3$) | 1-2% |
| Iron | 85-89% |
| Magnetite ($Fe_3O_4$) | 0-1% |
| Carbon | 2-6% |
| Wuestite (FeO) | 1-4% |

It was discovered that a high purity Fe (mild steel) could be obtained if the reduced powder was magnetically separated from the excess coal and other non magnetic impurities before melting. The table below shows the difference in quality of reduced powder that was melted as is v/s the melt of the magnetic fraction of reduced iron.

| | Melted reduced powder | Melted magnetic fraction |
|---|---|---|
| Fe | 96-97% | >99% |
| C | 2-3% | <0.25% |
| Si | 1-2% | <0.25% |
| S | 0.2-0.5% | approx 15% reduction in S |
| P | 0.05-0.2% | approx 30% reduction in P |

The reduced iron powder was fed at 1 kg/minute on to a rotating magnetic drum at 50 rpm with a magnetic strength of 1200 gauss while the collection gap between magnetic and non magnetic material was set at 10 mm. The split between magnetic and non magnetic material is typically 82-86% magnetic material and 14-18% non magnetic material.

The magnetic fraction of the reduced iron powder can be melted using various furnaces e.g. arc, induction or resistance.

Normally, the magnetic fraction contains between 78-82% metal while the gas loss is between 3-6%. Between 5-10% lime is normally blended with the magnetic iron powder before it is fed into the furnace. This helps with fluxing of the slag and to remove P and S from the iron. Arc and induction furnaces usually operate under oxidative conditions which assist with the removal of P from iron into the slag. Normally the oxidative conditions (high FeO content) in the slag prevent the removal of S from the iron and this is then done in a ladle. A typical ladle slag to remove S from iron is used in this ratio to the molten iron:

| | |
|---|---|
| 2% | $CaC_2$ (milled) |
| 1.5% | $CaF_2$ powder |
| 3% | $Al_2O_3$ powder |
| 8.5% | lime (milled) |
| 0.4% | Al buttons |

Unlike arc or induction furnaces, the atmosphere in carbon resistant furnaces is reducing. Depending on the P content in the iron, with the lime addition, sometimes it is necessary to blend 2-5% $Fe_2O_3$ powder to the magnetic iron powder in order to oxidize the P for it to be absorbed into the basic slag. In this case it is possible to extract both the S and P from the iron at the same time using the same slag.

By using this process (reduction of fines into iron powder in accordance with the method of the invention, magnetic separation of iron powder, homogenous addition of additives to the magnetic iron powder before melting and controlled melting of the powder) the production, directly from iron ore fines, of a mild steel master batch without going through the intermediate of pig iron, is possible.

This clean mild steel master batch (re-bar or flat iron), of which the S and P≤0.06% and C≤0.25%, can be used to produce various types of stainless steel by the addition of various alloys to it such as FeCr, FeMn, FeSi, FeV, FeMo, $FeC_3$ etc. Even more, these different types of alloys can be blended with the magnetic iron powder (and lime) before melting to obtain the correct product after desulphurization and dephosphorization.

The following calculations illustrate energy considerations for the process of the invention:

Energy required for heating the reduction mixture:

1 ton magnetite from 20° C. to 1050° C., $\Delta T = 1030°$ C.

$$CpM\Delta T = 1 \times 1t \times 1030° \text{ C.} = 1030\ MJ$$

388 kg *devol.* coal from 20° C. to 1050° C., $\Delta T = 1030°$ C.

$$CpM\Delta T = 1.7 \times 0.388t \times 1030° \text{ C.} = 679.4\ MJ$$

62 kg lime from 20° C. to 1050° C., $\Delta T = 1030°$ C.

$$CpM\Delta T = 0.8 \times 0.062t \times 1030° \text{ C.} = \frac{51.0\ MJ}{1760.4\ MJ}$$

Energy required to reduce iron at 1050° C.:

$$Fe_3O_4 + 4C = 3Fe + 4CO(g) 2734 \text{ MJ}$$

However, the magnetite used in this Example was only 91.2% pure=2493.4 MJ is needed. Typically the mass retained after reduction is 66% (1450 kg)=957 kg reduced powder.

Normally, approximately 84% of the reduced powder is recovered as the magnetic fraction=804 kg.

The energy required to melt this powder at 1535° C.:

804 kg+80 kg additive=884 kg is heated from 20° C. to 1535° C., ΔT=1515° C.

$$CpM\Delta T = 0.6 \times 0.884t \times 1515° \text{ C.} = 803.6 \text{ MJ}$$

At least 80% of the magnetic fraction (804 kg)=643 kg is recovered as iron. Energy needed to turn Fe (s) into Fe (l)=247 KJ/kg Fe, thus 159 MJ is needed for 643 kg iron.

Total energy needed=5216.4 MJ to yield 643 kg iron, or 2.25 MWh per ton of iron.

A ton of magnetite from Phalaborwa Mining Company contains 660 kg of iron. This means a recovery of 643 kg=97.4% efficiency.

As mentioned before, a ton of Phalaborwa Mining Company magnetite releases 441 kg CO (g) during reduction. When a kg of CO(g) burns in air, 10.2 MJ of energy is released. This means that 4498.2 MJ of energy is released when 441 kg CO(g) burns in air.

During the devolatization of coal, approximately 700 kg of coal is used to produce 400 kg devolatized coal. Release of energy to obtain 400 kg of devolatized coal:

$$(700 \text{ kg} \times 28) - (400 \text{ kg} \times 25) = 19600 - 10000 = 9600\ MJ$$

During the reduction of 1 ton Phalaborwa Mining Company magnetite, 388 kg devolatized coal is used, meaning 388/400×9600=9312 MJ of energy is released during devolatization.

The total energy release to reduce 1 ton of Phalaborwa Mining Company magnetite=13810 MJ. If 30% of this energy could be turned into electrical energy via steam generation, 4143 MJ per 643 kg Fe produced or 1.79 MWh/ton iron could be recovered. This means that approximately 75% of the energy required to produce 1 ton of iron could be obtained from the process.

Example 2

Haematite from Sishen, South Africa with the following composition and size distribution was used in this Example:

| | |
|---|---|
| Fe | 63.1% |
| $Fe_2O_3$ | 90.2% |
| $SiO_2$ | 5.6% |
| $Al_2O_3$ | 1.98% |
| S | 0.03% |
| P | 0.14% |
| $\partial^{90}$ | −800 μm |
| $\partial^{50}$ | −500 μm |
| $\partial^{10}$ | −200 μm |

The following formula represents the reduction equation for the haematite:

$$Fe_2O_3+3C=2Fe+3CO(g)$$

Based on 1 mol $Fe_2O_3$, the following calculations can be done:

1 mol $Fe_2O_3$=159.7 g, 90.2% purity=177 g 3 mol C=36 g, 73% purity=49.32 g

+50% excess devolatized coal=73.97 g (to exclude air in rotary)

It follows that, to reduce 1 ton haematite in the rotary kiln, you need 418 kg devolatized coal. 1 ton haematite contains 19.8 kg $Al_2O_3$ and 56 kg $SiO_2$. 418 kg devolatized coal contains 41.8 kg $SiO_2$ and 16.7 kg $Al_2O_3$. Total $SiO_2$=97.8 kg=1.63 kmol and total $Al_2O_3$=36.5 kg=0.358 kmol. Total CaO needed=1.988 kmol=111.33 kg, 89% purity=125 kg.

The reduction mixture (based on 1 ton haematite) is thus:

1 ton haematite (90.2%) (dried at 300° C.)

418 kg devolatized coal (73%)

125 kg lime (89%)

1543 kg

This material was reduced just like the magnetite in Example 1 and similar results were obtained.

The minimum tube diameter for a superficial gas velocity <1 m/s can be calculated as follows (assuming voidage approximates 1):

$$450 \text{ kg CO} = 16 \text{ kmol of gas}$$

$$\text{At } STP,\ 1 \text{ mol gas} = 22.4\ell(273 \text{ k})$$

$$\text{Therefore, } 16 \text{ kmol gas} = 16000 \times 22.4\ell$$

$$= 358.4 \text{ m}^3$$

$$\text{At } 1050^\circ \text{ C. } (1323 \text{ k}) = \frac{1323}{273} \times 358.4 \text{ m}^3$$

$$= 1736.86 \text{ m}^3$$

If the reduction reaction occurs over an hour, the superficial gas velocity per second will be 0.482 $m^3/s$.

$$\text{Area of cylinder} = \frac{\pi}{4} \times \partial^2$$

$$\text{Volume}/s = \text{area} \times \text{velocity}$$

Therefore, $$0.482 \text{ m}^3/\text{s} = \frac{\pi}{4} \times \partial^2 \times v$$

If v=1 m/s the tube diameter is $$\partial = \sqrt{\frac{4 \times 0.482}{\pi \times 1}} = 0.783 \text{ m}$$

If a tube with a diameter of 1 m and a length of 6 m is used, the volume of the tube would be 4700 l. A 15% bed load would be 705 l. The bulk density of the feed mixture is approximately 2 g/ml, therefore 705 l load will have a mass of 1410 kg. This means if 1450 kg of blended material (example 1) is fed per hour at 1050° C. (product temperature) through a rotary kiln with the above dimensions, the superficial gas velocity would be less than 1 $ms^{-1}$.

If the method of the invention, as illustrated, is compared with the traditional blast furnace method of manufacturing iron the main differences are the following. Firstly, the blast furnace is replaced by a rotary kiln. The refractory lining of the blast furnace is not required and the method of the invention is conducted in a stainless steel tubular reactor. The feed material used in the blast furnace generally has a particle size greater than 6 mm whilst the feed used in the method of the invention is a waste material which has a particle size of less then 0.5 mm. Heating a blast furnace is internal via fossil fuel and carbon monoxide whilst heating of the rotary kiln is by external electric heating. In addition, where a blast furnace operates at gas velocities in excess of 10 $ms^{-1}$ the method of the invention operates at low superficial gas velocities, typically less than 2 $ms^{-1}$ to avoid entrainment of the finally powdered reactants. Further, where a blast furnace operates at a temperature gradient of between about 200° C. and 1600° C., in the method of the invention, as illustrated, the entire process is carried out at a constant temperature of 1050° C. The product from the traditional blast furnace is liquid iron whereas the product of the method of the invention is a fine granular iron powder. Further, the by-product from a blast furnace is carbon dioxide and operating a blast furnace requires a carbonaceous flux whereas the by-product of the method of the invention is carbon monoxide, which can be used to generate electricity, and the method of the invention requires metal oxide fluxes. Of particular economic importance, where a blast furnace has a fixed locality, the reactor of the invention can be transported to an area in which it is required. In this way costs are substantially reduced because the raw materials do not have to be transported to the reactor.

It is also an advantage of the invention illustrated that the granular iron product is produced with little or no associated dust. It is also an advantage of the invention illustrated that the high surface area of the finely divided iron oxide and coal increases the rate of reduction and reduces the retention time in the rotary kiln. This, in turn, means an increased throughput when compared with a blast furnace. The Applicant estimates that the cost per ton of iron produced by the method of the invention will be about one half of the cost per ton of pig iron produced in a conventional blast furnace.

The XRD powder pattern of the reduced material in Example 1 indicates a high reduction efficiency (ratio between Fe and FeO). This arises because of the control over the reduction process which is possible by the method of the invention. It is a further advantage of the invention illustrated that the product is an iron powder and not a molten mass. This permits the addition of additives to the iron powder prior to melting it. In this regard, it is far more difficult to add additives and mix such additives homogeneously into a molten mass. This in turn means that the carbon level after reduction can be controlled more efficiently by mixing an oxidizing agent such as $Fe_2O_3$ with the iron powder prior to melting. It is also possible to add other metals or metal oxides to the iron powder prior to melting. It is a particular advantage of the invention that, by magnetically removing excess coal from the iron product prior to smelting, the quality of the iron is substantially improved to the extent that it meets the specifications of mild steel. This results in a substantial increase in the value of the product. As mentioned above, it is also possible to produce a stainless steel ingot instead of a pig-iron ingot. In this way, the value of the product can be further substantially increased in that a stainless steel may be produced directly from an iron oxide reduction process without the intermediacy of further smelting processes. This represents a very substantial improvement on existing methods for producing stainless steel. It is a further advantage of the invention that, unlike, traditional methods, the method of the invention does not use the carbon monoxide formed in the reduction process to generate energy internally by reacting it with oxygen. The method of the invention produces relatively pure carbon monoxide gas as a by-product and this can be used externally as a fuel source to generate electricity via a steam generator. The invention, in particular, allows the thousands of tons of waste iron oxide and waste coal which is available in many parts of the world to be profitably converted to iron.

The invention claimed is:

1. A method for the production of iron from an iron oxide-containing material, the method including:

feeding a pre-determined quantity of an iron oxide-containing material with a particle size distribution range with a $\partial^{90}$ of less than 2 mm and a predetermined quantity of an excess of carbon-containing material with a particle size distribution range with a $\partial^{90}$ of less than 6 mm, into an inclined externally electrically heated rotating cylindrical reactor or rotary kiln capable of routinely producing at least 1000 kg/h of iron;

contacting the iron-oxide-containing material and the carbon-containing material in the externally electrically heated rotating cylindrical reactor or rotary kiln at a temperature of between 900° C. and 1200° C. for a contact time of between 30 minutes and 360 minutes to reduce the iron oxide to iron powder, the feed rates of the iron oxide-containing material and the carbon-containing material and the operating temperature of the reactor being selected so that a superficial gas flow rate through the reactor caused by the release of gases resulting from the reduction is less than 2 $ms^{-1}$; and magnetically separating product iron powder from excess carbon-containing material.

2. The method as claimed in claim 1, in which the iron oxide-containing material has a $\partial^{90}$ of less than 1 mm.

3. The method as claimed in claim 2, in which the iron oxide-containing material has a $\partial^{90}$ of less than 500 μm.

4. The method as claimed in claim 1, in which the carbon-containing material has a $\partial^{90}$ of less than 2 mm.

5. The method as claimed in claim 4, in which the carbon-containing material has a $\partial^{90}$ of less than 1 mm.

6. The method as claimed in claim 1, in which the carbon-containing material is de-volatilised coal fines.

7. The method as claimed in claim 1, in which the temperature in the reactor is between 1000° C. and 1100° C.

8. The method as claimed in claim 1, which includes preventing ingress of air into the reactor.

9. The method as claimed in claim 1, which includes controlling iron oxide-containing material and carbon-containing material feed rate, reactor temperature and gas withdrawal rate from the reactor to achieve a substantially steady state concentration of carbon monoxide in the reactor.

10. The method as claimed in claim 1 which includes the step of recovering excess carbon monoxide withdrawn from the reactor, using the excess carbon monoxide to produce energy and using the energy produced to heat the reactor.

* * * * *